US008100146B2

(12) United States Patent
van der Meijden et al.

(10) Patent No.: US 8,100,146 B2
(45) Date of Patent: Jan. 24, 2012

(54) FLEXIBLE VALVE ASSEMBLIES PRINCIPALLY FOR AUTOMATIC SWIMMING POOL CLEANERS

(75) Inventors: Hendrikus Johannes van der Meijden, Midrand (ZA); Michael Edward Moore, Johannesburg (ZA)

(73) Assignee: Zodiac Pool Systems, Inc., Moorpark, CA (US)

( * ) Notice: Subject to any disclaimer, the term of this patent is extended or adjusted under 35 U.S.C. 154(b) by 753 days.

(21) Appl. No.: 12/099,815

(22) Filed: Apr. 9, 2008

(65) Prior Publication Data

US 2008/0251143 A1 Oct. 16, 2008

Related U.S. Application Data

(60) Provisional application No. 60/922,602, filed on Apr. 10, 2007.

(51) Int. Cl.
*G05D 16/06* (2006.01)

(52) U.S. Cl. ..... 137/843; 251/366; 15/1.7

(58) Field of Classification Search ..... 137/843; 15/1.7; 251/5, 366
See application file for complete search history.

(56) References Cited

U.S. PATENT DOCUMENTS

| | | | | |
|---|---|---|---|---|
| 4,642,833 | A | 2/1987 | Stoltz et al. | |
| 4,742,593 | A | 5/1988 | Kallenbach | |
| 5,265,297 | A | 11/1993 | Gould et al. | |
| 5,315,728 | A * | 5/1994 | Atkins | 15/1.7 |
| 5,769,125 | A | 6/1998 | Duer et al. | |
| 6,098,228 | A | 8/2000 | Chang | |
| 6,292,969 | B1 * | 9/2001 | Supra | 15/1.7 |
| 6,536,467 | B2 * | 3/2003 | Wu et al. | 137/543.19 |
| 7,337,803 | B2 | 3/2008 | van der Meijden et al. | |
| 2006/0032539 | A1 | 2/2006 | van der Meijden et al. | |
| 2006/0054229 | A1 | 3/2006 | van der Meijden et al. | |
| 2007/0261183 | A1 | 11/2007 | Moore et al. | |
| 2007/0262277 | A1 * | 11/2007 | Williams et al. | 251/7 |

FOREIGN PATENT DOCUMENTS

| | | |
|---|---|---|
| GB | 2190466 | 11/1987 |

OTHER PUBLICATIONS

International Search Report and Written Opinion in related Application No. PCT/US200/059698.

* cited by examiner

*Primary Examiner* — Kevin Lee

(74) *Attorney, Agent, or Firm* — Dean W. Russell; Kilpatrick Townsend & Stockton LLP

(57) ABSTRACT

Flexible valves principally (although not necessarily exclusively) for automatic swimming pool cleaners are addressed. The valves have generally parabolic closure regions and do not present linear transverse cross-sections to water flowing through them. The closure regions may extend substantially below the transverse center lines of the valves, which additionally may include teeth at or near hinges of the closure regions. Including the hinges reduces likelihood of undesired wear at or near the outlets of the valves.

14 Claims, 5 Drawing Sheets

FLEXIBLE VALVE ASSEMBLIES PRINCIPALLY FOR AUTOMATIC SWIMMING POOL CLEANERS

CROSS REFERENCE TO RELATED APPLICATION

This application claims the benefit of U.S. Provisional Application No. 60/922,602 filed on Apr. 10, 2007, the contents of which are incorporated herein by reference.

FIELD OF THE INVENTION

This invention relates principally to components of devices for cleaning fluid-containing vessels and more particularly, although not necessarily exclusively, to valve assemblies for water interruption-type automatic cleaners for swimming pools.

BACKGROUND OF THE INVENTION

Commonly-owned U.S. Pat. No. 4,642,833 to Stoltz, et al. (the "Stoltz Patent"), whose contents are incorporated herein in their entirety by this reference, discloses various valve assemblies useful for automatic swimming pool cleaners. These assemblies typically include flexible, generally tubular diaphragms surrounded by chambers, with the diaphragms interposed in the main fluid-flow paths through the cleaners. In response to variation in pressure internally and externally, the diaphragms contract and expand transversely along at least part of their lengths, thereby controlling fluid flow therethrough.

Mentioned in the Stoltz Patent is that versions of the diaphragms may have "substantially oval-shaped or diamond-shaped cross section . . . when a total fluid flow interruption is to be achieved." See Stoltz Patent, col. 3, ll. 36-38. Also detailed in the Stoltz Patent is use of longitudinal ribs "along that part [of a diaphragm] which contracts to the greatest extent." See id., col. 5, ll. 32-33. According to the Stoltz Patent, such ribs enable a diaphragm to contract to an X-shaped pattern depicted in FIG. 7 of the patent. See id. ll. 33-35.

Commonly-owned U.S. Pat. No. 4,742,593 to Kallenbach (the "Kallenbach Patent"), the contents of which also are incorporated herein in their entirety by this reference, discloses additional valve assemblies for use with automatic swimming pool cleaners. These assemblies too are generally tubular in shape and made of flexible material. As noted in the Kallenbach Patent:

> The body [of the tubular valve] has an intermediate section between the ends that assumes a substantially collapsed condition over a segment thereof in absence of a pressure differential between the interior and exterior. The section preferably is collapsed transversely over a segment.
>
> Along the collapsed segment, the body has diverging interior walls in the direction of water flow therethrough. The walls diverge from a substantially constant diameter that extends for a portion of the section adjacent the first end to a substantially constant, but larger, diameter that extends for a portion of the section adjacent the second end. Further, the divergence is a substantially linear function of the distance along the segment.

See Kallenbach Patent, col. 1, ll. 28-42.

U.S. Pat. No. 6,098,228 to Chang (the "Chang Patent"), entitled "Pool Cleaner Diaphragm Valve," likewise addresses diaphragm-style valves and ancillary assemblies for automatic swimming pool cleaners. Apparently, however, these valves are of the type specified in the Kallenbach Patent. Indeed, according to the Chang Patent, this type of valve "is ideal" for the purposes described therein. See Chang Patent, col. 6, ll. 60-65.

Commonly-owned U.S. Patent Publication No. 2006/0054229 of van der Meijden, et al. (the "van der Meij den Publication"), whose contents are incorporated herein in their entirety by this reference, addresses further generally-tubular valve assemblies. Preferred embodiments of the assemblies include mouths divided into three parts. As stated in the van der Meij den Publication, this division "admits a larger through hole within the valves, in turn enabling larger debris to pass." See van der Meijden Publication, p. 1, ¶ 0008.

SUMMARY OF THE INVENTION

The present invention provides alternatives to the valves of the Stoltz and Kallenbach Patents and the van der Meijden Publication. Included in the present valves is a closure region substantially larger than those in existing flexible valves. This region advantageously is shaped substantially in the form of a parabola or "V," thus causing it to resemble the beak of a duck. At least in part because of its generally parabolic shape, the closure region does not present linear transverse cross-section to water flowing toward it.

Additionally, at least a portion of the closure region is closer to the inlet of the valve than in conventional valves. This portion, including the "tip" part (vertex) of the "beak" (parabola), may extend significantly below the lateral center line of the flexible valve. By contrast, for example, section 98 of valve 14 of commonly-owned U.S. Patent Publication No. 2006/0032539 of van der Meijden, et al. appears at or near the lateral center line of valve 14 of that publication.

By reshaping the closure region, flexible diaphragm-type valves of the present invention change their hinging action as well. In particular, substantial surface area is now included as the hinge, reducing the flexure load on the outlet from that experienced in existing valves. Valves of the present invention thus are expected to have more durable hinges than conventional flexible valves and thereby reduce wear at their outlets.

Present valves also may include teeth at or near the hinges of the closure region. Such teeth, together with corresponding recesses, function to reduce the likelihood of lateral movement of one portion of the valve relative to another. This decreased lateral movement further reduces wear in the vicinity of the hinging area. Reinforcing material, moreover, may be provided either internal or external to the valve walls.

It thus is an optional, non-exclusive object of the present invention to provide novel valves for devices such as automatic swimming pool cleaners.

It is an additional optional, non-exclusive object of the present invention to provide flexible valves having closure regions of substantially parabolic or "V" shape.

It is also an optional, non-exclusive object of the present invention to provide flexible valves, in the form of diaphragms, having closure regions extending closer to the fluid inlets of the valves.

It is another optional, non-exclusive object of the present invention to provide valves with hinging areas for enhanced durability.

It is a further optional, non-exclusive object of the present invention to provide valves including teeth and corresponding recesses for limiting lateral movement of one portion of the valves relative to another.

It is, moreover, an optional, non-exclusive object of the present invention to provide valves which do not present linear transverse cross-section to water flowing toward them.

It is yet another object of the present invention to provide reinforcing material for the valve walls.

Other objects, features, and advantages of the present invention will be apparent to those skilled in the appropriate field with reference to the remaining text and the drawings of this application.

DETAILED DESCRIPTION

Figure 1:
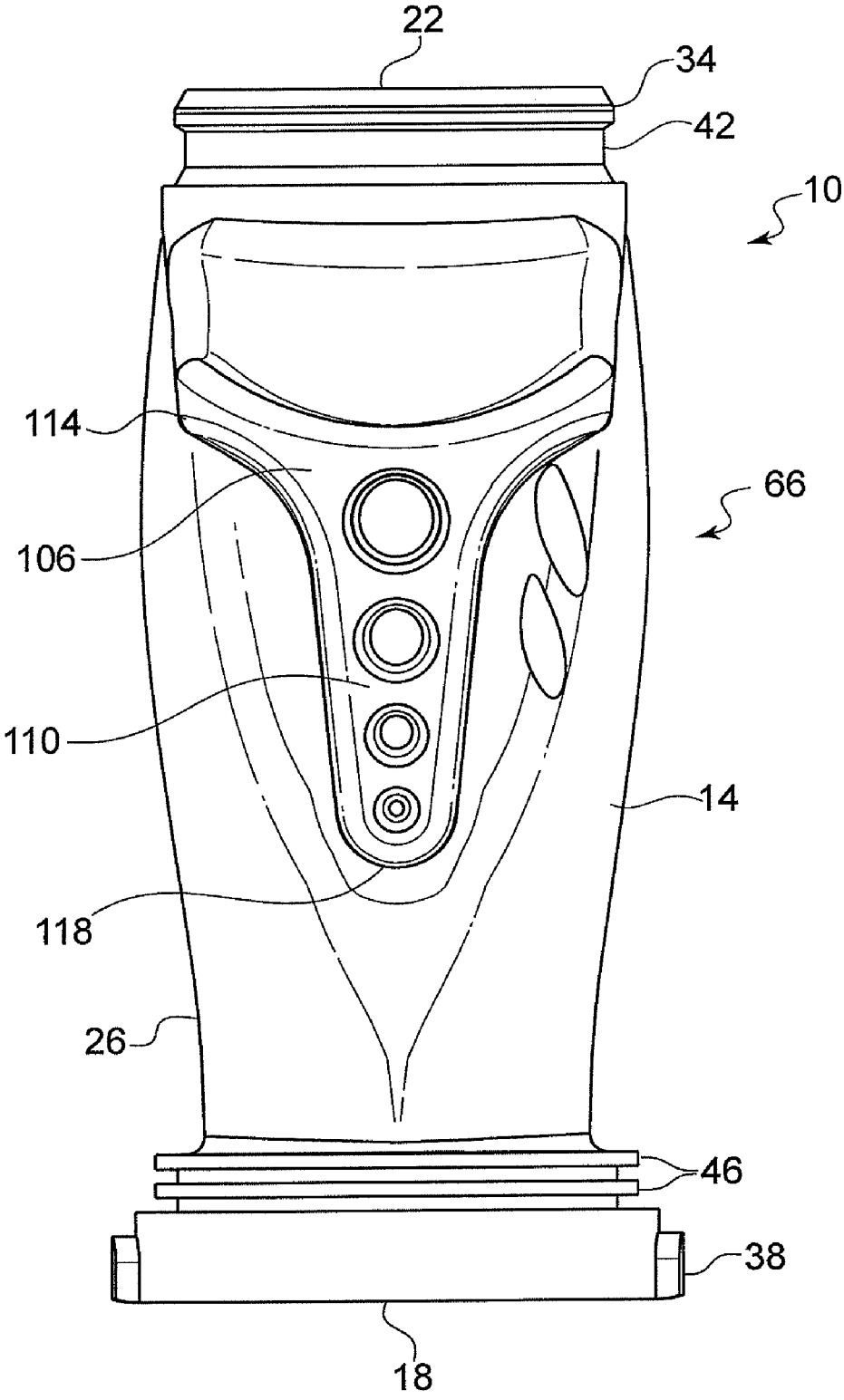
FIG. 1 is an elevational view of one side of a valve of the present invention.

Illustrated in FIGS. 1-5 is exemplary valve 10 of the present invention. Valve 10 comprises body 14 together with inlet 18 and outlet 22. Body 14 has exterior surface 26 and interior surface 30 and preferably, although not necessarily, is generally tubular in shape. Body 14 typically is formed of a flexible, rubbery material and molded as a single part; those skilled in the appropriate art will, however, recognize that other types of body 14 may be suitable instead.

Depicted as well in FIGS. 1-5 are collars 34 and 38, recess 42, and one or more flexible sealing rings 46 of body 14 useful for, among other things, connecting valve 10 to other components of an automatic swimming pool cleaner. Collar 34 and recess 42, forming part of exterior surface 26 at or adjacent outlet 22, typically interlock directly or indirectly (or are co-molded with) extension pipes of the cleaner so as to fix the position of outlet 22 relative to the pipes (which in turn typically connect directly or indirectly to a flexible hose). Conventional valves are subject to wear in the region where the interlock occurs.

Collars 38 and rings 46 likewise form part of exterior surface 26. Near inlet 18, collar 38 and rings 46 connect body 14 of valve 10 to components within a head of the cleaner adjacent the mouth thereof. None of collars 34 or 38, recess 42, or rings 46 need necessarily be present on body 14, however, as other connecting mechanisms may be used instead.

Preferably, valve 10 is positioned in the main fluid flow path within the cleaner. If so positioned, fluid in the form of water entering the mouth of the cleaner must pass through body 14 of valve 10 before exiting via the extension pipes. Entrained in the water stream typically will be debris (e.g., sticks, leaves, etc.), some or all of which also must pass through valve 10 and may tend to clog the passage defined by interior surface 30 of body 14.

Figure 2:
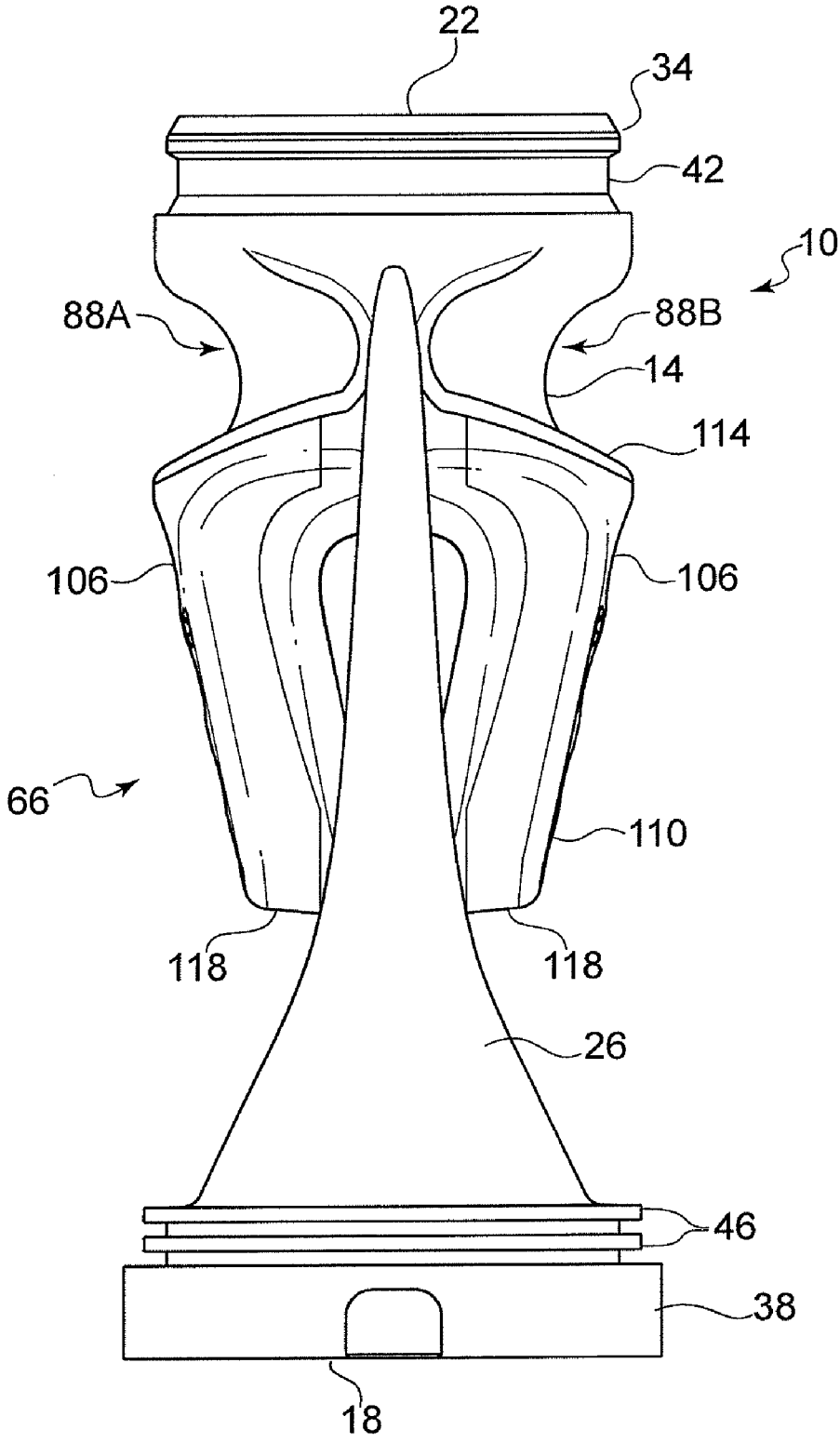
FIG. 2 is an elevational view of FIG. 1 with the valve having been rotated approximately ninety degrees.
Figure 3:
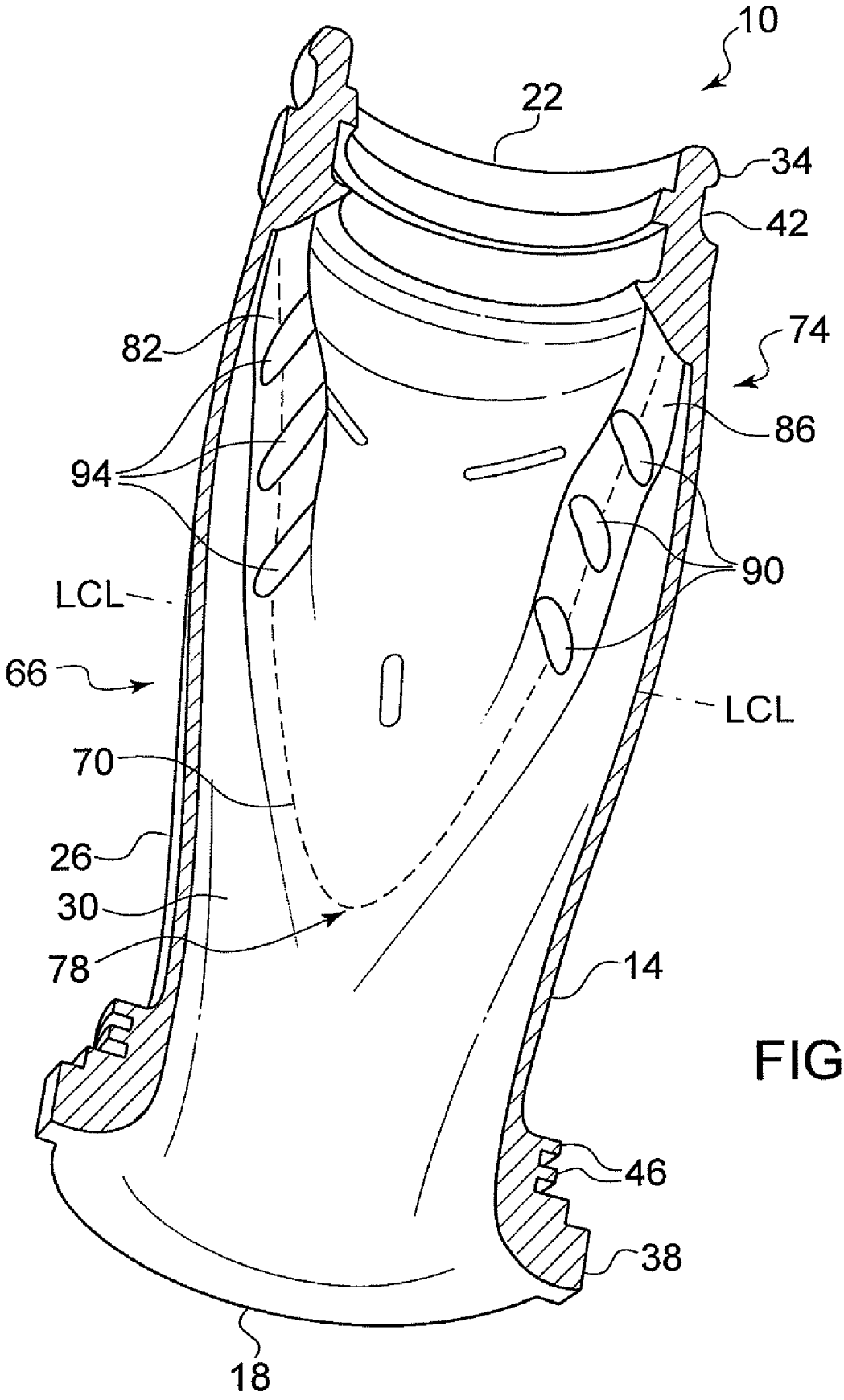
FIG. 3 is a longitudinal cross-sectional view of the valve of FIG. 1.

Intermediate inlet 18 and outlet 22 of valve 10 is section 66. As illustrated in each of FIGS. 1-5, section 66 beneficially is collapsed transversely so as to form mouth 70 of body 14. FIG. 3, especially, details a preferred mouth 70 having somewhat of a parabolic, or "V," shape (shown in dashed lines) extending generally from a (nominally) upper portion 74 of valve 10 toward inlet 18. Vertex 78 of mouth 70, further, is positioned well below lateral center line LCL of body 14, substantially closer to inlet 18 than are mouths of conventional valves.

Hence, rather than presenting an essentially linear transverse cross-section to fluid flowing through body 14, mouth 70 presents a curved, non-linear cross-section effectively tailing away toward outlet 22. This shape and the positioning of mouth 70 are advantageous in many situations, as they permit achievement of different closing forces and timing than in existing valves. Depending on the characteristics of pumps which will influence operation of valve 10 and the aquatic environments in which cleaners containing valve 10 will be used, beneficial operations of the cleaners may result.

Termination of mouth 70 remote from vertex 78 occurs in upper portion 74 of valve 10. Termination regions 82 and 86 are formed (at least in some respects) as hinges for mouth 70, flexing as mouth 70 cyclically opens and closes in use. Also present as part of body 14 are semi-circumferential hinging areas 88A-B. Illustrated in FIGS. 2 and 4 as scalloped regions, hinging areas 88A-B bend as mouth 70 open and closes. Because hinging areas 88A-B are large relative to corresponding sections of other valves, they distribute the bending force over a larger area than is conventional, lowering flexure stress to which upper portion 74 is subjected. Displacing flexure load to these hinging areas 88A-B likewise decreases flexure of valve 10 at or adjacent outlet 22, resulting in less wear of body 14 at the outlet 22 (i.e. where connection to extension pipes occurs).

Figure 4:
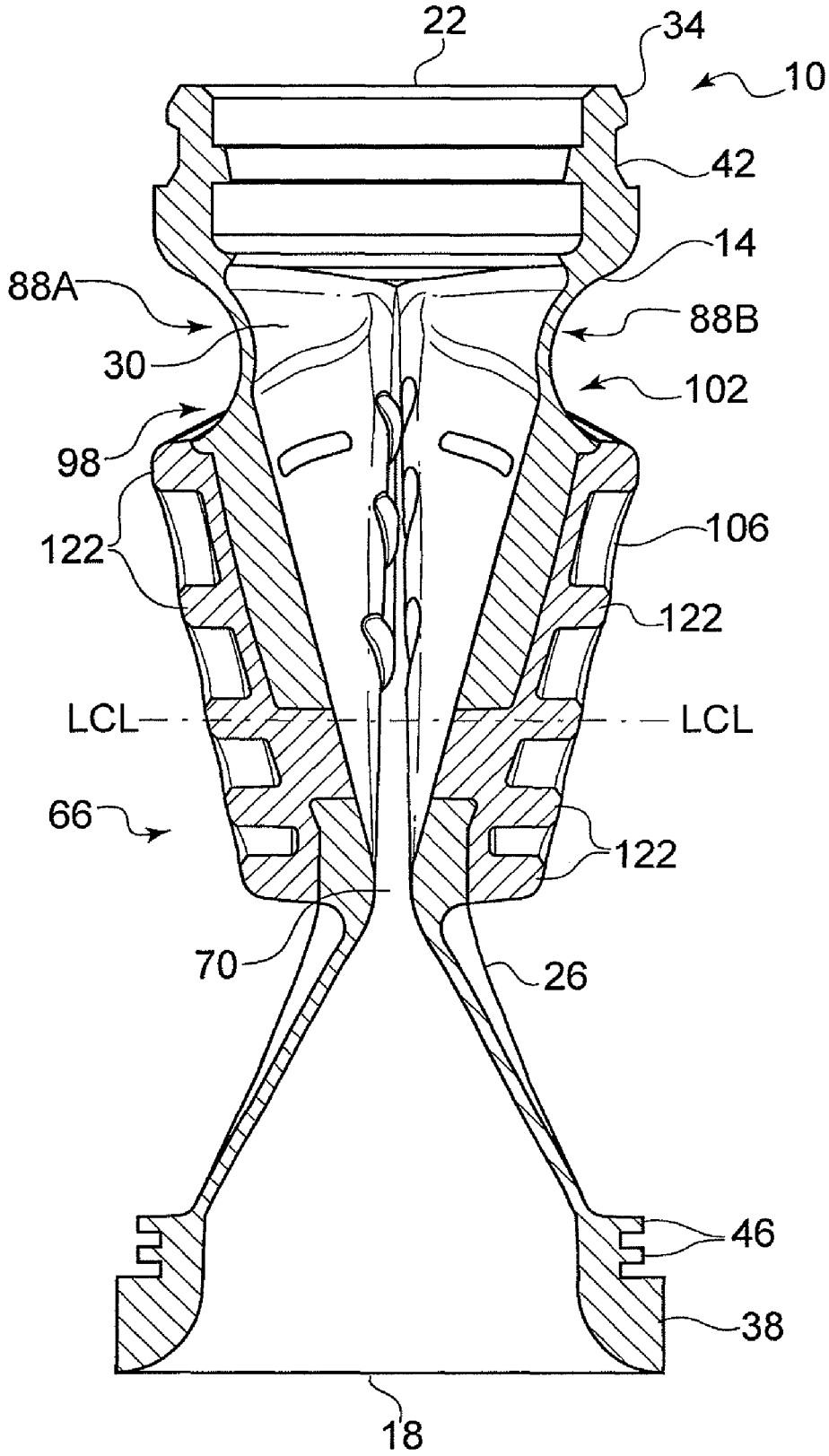
FIG. 4 is a longitudinal cross-sectional view of the valve as rotated in FIG. 2.
Figure 5:
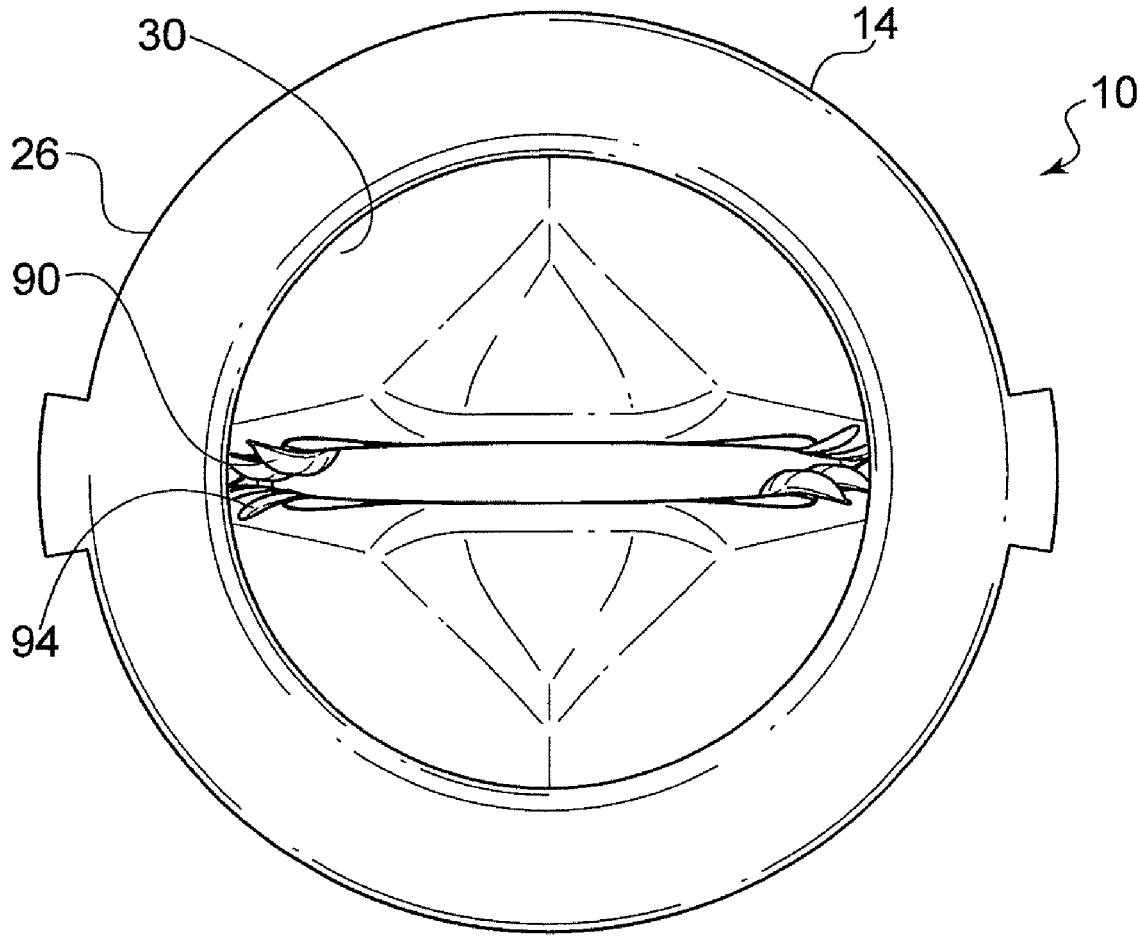
FIG. 5 is a lateral cross-sectional view of the valve of FIG. 1.

Shown especially in FIGS. 3-5 are teeth 90 and recesses 94. Teeth 90 preferably are formed on interior surface 30 within first longitudinal portion 98 of body 14, while recesses 94 are created within interior surface 30 in second longitudinal portion 102 of body 14. Placement of teeth 90 and recesses 94 correspond so that teeth 90 fit within recesses 94 when mouth 70 closes. This fitting helps reduce any tendency of first longitudinal portion 98 to move laterally relative to second longitudinal portion 102 as the hinges flex, assisting preventing frictional wear that would result should such lateral movement occur. Although six teeth 90 and six recesses 94 (three of each in each of termination regions 82 and 86) are depicted in the figures, more or fewer (or none) of such teeth 90 and recesses 94 may be employed instead.

Formed (preferably) on exterior surface 26 of body 14 is reinforcing material 106 for the valve wall. Material 106 may be harder than the material from which body 14 is made, thus providing greater structural rigidity to portions of the body 14. Although typically molded onto body 14, reinforcing material 106, if present, may be attached or connected to or within body 14 in any suitable way.

In some embodiments of valve 10, material 106 has a complex outer shape comprising a generally parabolic section 110 and a generally circumferential section 114. Vertex 118 of section 110 is placed near vertex 78 of mouth 70; by contrast, circumferential section 114 is positioned near the hinges formed at termination regions 82 and 86. As illustrated in FIGS. 2 and 4, material 106 preferably is incorporated onto each of first and second longitudinal portions 98 and 102. To assist molding, exterior surface 26 may include flanges 122 with which material 106 interacts.

Similar to ribs of the valve of the Kallenbach patent, reinforcing material 106 functions to, among other things, stiffen valve 10 in the axial or longitudinal direction. The stiffness facilitates valve 10 resisting forces acting on it during closure of mouth 70, reducing likelihood of section 66 collapsing (undesirably) in the vicinity of outlet 22. Although, as noted above, reinforcing material 106 may be harder than body 14, it need not necessarily always be so.

In use, valve 10 typically is deployed within an automatic pool cleaner in fluid communication with the inlet side of a pump. When the pump operates, its generally tends to evacuate the interior region of valve 10, causing debris-laden water of a swimming pool to pass therethrough. More specifically, operation of the pump produces cyclical opening and closing of mouth 70, creating water-hammer effect as mouth 70 closes to supply motive force to the cleaner. Those skilled in the art will understand that mouth 70 need not necessarily close completely as it cycles; instead, substantial closure may produce satisfactory results.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A valve having an inlet and an outlet and comprising a body defining a fluid passage therethrough, the body comprising (a) a flexible wall and (b) a mouth intermediate the inlet and the outlet, the mouth being shaped generally in the form of a "V" or parabola.

2. A valve according to claim 1 further comprising means for connecting to one or more components of an automatic swimming pool cleaner.

3. A valve having an inlet and an outlet and comprising a body defining a fluid passage therethrough, the body comprising (a) a flexible wall and (b) a mouth intermediate the inlet and the outlet, the mouth (i) being shaped generally in the form of a "V" or parabola and (ii) defining a vertex positioned closer to the inlet than to the outlet.

4. A valve having an inlet and an outlet and comprising a body defining a fluid passage therethrough, the body comprising (a) a flexible wall and (b) a mouth intermediate the inlet and the outlet, the mouth being shaped generally in the form of a "V" or parabola defining termination regions closer to the outlet than to the inlet.

5. A valve according to claim 4 in which the termination regions flex as the mouth cyclically opens and closes in use.

6. A valve having an inlet and an outlet and comprising a body defining a fluid passage therethrough, the body comprising (a) a flexible wall, (b) a mouth intermediate the inlet and the outlet, the mouth being shaped generally in the form of a "V" or parabola, and (c) hinging areas configured to bend as the mouth opens and closes in use.

7. A valve according to claim 6 in which the hinging areas are (a) at least semi-circumferential and (b) closer to the outlet than to the inlet.

8. A valve having an inlet and an outlet and comprising a body defining a fluid passage therethrough, the body comprising (a) a flexible wall, (b) a mouth intermediate the inlet and the outlet, the mouth being shaped generally in the form of a "V" or parabola, and (c) teeth and recesses.

9. A valve according to claim 8 in which (a) the body has an interior surface, (b) the teeth are formed on the interior surface, and (c) the recesses are created within the interior surface.

10. A valve according to claim 9 in which each tooth fits within a recess when the mouth closes in use.

11. A valve having an inlet and an outlet and comprising (a) a body defining a fluid passage therethrough and having an exterior surface, the body comprising (i) a flexible wall and (ii) a mouth intermediate the inlet and the outlet, the mouth being shaped generally in the form of a "V" or parabola, and (b) reinforcing material on the exterior surface, at least a portion of the reinforcing material having a generally "V" or parabolic shape.

12. A valve according to claim 11 in which the reinforcing material is harder than the body.

13. A flexible diaphragm valve configured for use as part of an automatic swimming pool cleaner, the valve comprising a closure region of substantially parabolic or "V" shape.

14. A valve having an inlet and an outlet and comprising:

a. a body defining a fluid passage therethrough, the body having an interior surface and an exterior surface and comprising:
   - i. a flexible wall;
   - ii. a mouth intermediate the inlet and the outlet, the mouth:
     - (A) being shaped generally in the form of a "V" or parabola;
     - (B) defining a vertex positioned closer to the inlet than to the outlet; and
     - (C) defining termination regions closer to the outlet than to the inlet, the termination regions flexing as the mouth cyclically opens and closes in use;
   - iii. hinging areas configured to bend as the mouth opens and closes in use, the hinging areas being (A) at least semi-circumferential and (B) closer to the outlet than to the inlet;
   - iv. teeth formed on the interior surface; and
   - v. recesses created within the interior surface, each recess receiving a tooth when the mouth closes in use;

b. reinforcing material on the exterior surface, at least a portion of the reinforcing material having a generally "V" or parabolic shape and being harder than the body; and c. means for connecting to one or more components of an automatic swimming pool cleaner.

* * * * *